US005171175A

United States Patent [19]

Buzzi

[11] Patent Number: 5,171,175

[45] Date of Patent: Dec. 15, 1992

[54] DEVICE WITH CAVITATIONAL EFFECT FOR PROPELLERS OF WATERCRAFT WITH A PLANING OR SEMIPLANING KEEL

[76] Inventor: Fabio Buzzi, Via Per Lecco 1, 22048 Oggiono (Prov. of Como), Italy

[21] Appl. No.: 650,165

[22] Filed: Feb. 4, 1991

Related U.S. Application Data

[63] Continuation-in-part of Ser. No. 333,541, Apr. 5, 1989, Pat. No. 5,046,975.

[30] Foreign Application Priority Data

Apr. 5, 1988 [IT] Italy ..... 20092 A/88

[51] Int. Cl.[5] ..... B63H 1/18

[52] U.S. Cl. ..... 440/66

[58] Field of Search ..... 440/66, 68, 69; 416/90 A, 92

[56] References Cited

U.S. PATENT DOCUMENTS

| | | | |
|---|---|---|---|
| 1,470,191 | 10/1923 | Reid | 440/66 |
| 3,434,447 | 3/1969 | Christensen et al. | 440/66 |
| 4,383,829 | 5/1983 | Allen, Jr. | 440/66 X |
| 4,689,026 | 8/1987 | Small | 440/69 X |
| 4,941,423 | 7/1990 | Van Tassel | 440/69 X |

*Primary Examiner*—Sherman Basinger

[57] ABSTRACT

The device induces cavitation in at least a propeller of an engine-driven watercraft with a planing or semiplaning keel. The device generates a depression area in the front part of the same propeller and connects the area with atmosphere by air ducts, thereby allowing planing speed to be attained more rapidly and better utilization of the engine power during the transient stages before attaining planing speed.

10 Claims, 3 Drawing Sheets

DEVICE WITH CAVITATIONAL EFFECT FOR PROPELLERS OF WATERCRAFT WITH A PLANING OR SEMIPLANING KEEL

CROSS REFERENCE TO RELATED APPLICATIONS

This is a continuation-in-part of application Ser. No. 07/333,541 filed on Apr. 5, 1989, now U.S. Pat. No. 5,046,975.

FIELD OF THE INVENTION

This invention relates to a device with a cavitational effect for propellers used for propelling watercraft with a planing or semiplaning keel.

BACKGROUND OF THE INVENTION

One of the main categories of engine-powered watercraft comprises watercraft with a planing or semiplaning keel; such keels enable the hull to plane when determined hydrodynamic support conditions are attained, i.e. when the weight of the hull is supported mainly by the dynamic action between the water and the keel plane.

The watercraft thus rises on the water and slides thereon instead of simply floating thereon. These planing conditions occur only at high speed, and it is therefore extremely important to as quickly as possible pass through the transient conditions between the moment in which the hull simply floats, not having as yet attained the speed required for planing, and the moment in which it planes.

It is apparent that the duration of this transient period depends on the ability to fully use the engine power. As these watercraft use a propeller propulsion system, the problem of the duration of the transient period corresponds to solving the problem of optimising the propeller operation.

Increasing the propeller speed is known to create certain problems, deriving from the fact that to develop maximum thrust the water must slide over the propeller blades with as little turbulence as possible, so that a vacuum is created on its front face. If the propeller is accelerated such that this vacuum is less than that exerted overall by the water, the flow alters and gives rise to the phenomenon of cavitation, which results in a rapid reduction in the torque absorbed by the propeller and an even greater reduction in the developed thrust.

The propeller thrust is greater if the volume and speed of the mass of water which traverse the propeller disc per unit of time are higher and its acceleration is lower; therefore many types of propeller and many types of propeller-engine coupling have been studied to optimise the propulsion efficiency of a watercraft as a function of its keel shape and speed characteristics.

In the case of planing or semiplaning keels, propellers of high speed type are frequently used, to ensure that the high speed required for planing is obtained.

Before the watercraft has reached the speed required for planing, such propellers are not operating in optimum conditions because they are rotating at low r.p.m. and cannot be raised rapidly to the required r.p.m.. Current marine propulsion units do not in fact have change-speed gears so that the propeller drive torque can only adapt to the resistant torque if the drive torque is always greater than the resistant torque. This means that the engine r.p.m. must be gradually increased. Only when the planing speed for the watercraft is reached will the engine operate under optimum maximum drive torque conditions.

The methods used up to the present time to solve this problem are not however totally satisfactory and new solutions are continuously sought by experts in the art, specially for high-speed or competition crafts for which the time required for attaining planing speed is very important.

SUMMARY OF THE INVENTION

It is now possible to utilize the cavitational effect itself to satisfactorily solve or at least to better solve than in the case of previously adopted solutions, the problem of utilizing maximum engine torque and of its use in attaining the planing speed for a watercraft with a planing or semiplaning keel within a short time.

The invention provides air ducts in the front part of a fixed or movable propeller wall means or in order to generate a depression area and to connect this area with the atmosphere.

According to a characteristic of the invention, the device, which enables the cavitational effect caused by the movement of a propeller to be utilized in reducing the time required to attain engine power optimum speeds, comprises at least a controllable air flow duct which enables air withdrawn from above the hull water line to directly reach the front part of at least a propeller and first support means for said propeller and second support means for said air duct, said air flow duct having its top in communication with the atmosphere above the water line and being provided with a valve for controlling the air flow therethrough, said first support means forming said wall means and being suitably shaped to generate in the front part of said propeller a depression area favorable for the cavitation of the same propeller.

According to another characteristic of the invention, said first support means are suitably shaped to support said air duct and to generate in the front part of said propeller a depression area favorable for the cavitation of the same propeller.

Advantageously said second support means are formed by the same first support means, suitably shaped to support said air duct and to generate in the front part of said propeller a depression area favorable for the cavitation of the same propeller, and preferably said second support means are formed by the same first support means suitably shaped and hollow to support said duct by enclosing it and to generate in the front part of the propeller a depression area favorable for the cavitation of the same propeller.

According to a further characteristic of the invention, said second support means form said wall means and are adjustable at will relative to said propeller to generate in the front part of said propeller a depression area favorable for the cavitation of the same propeller, and to positionally set the outlet of said air duct along the diameter of said propeller from at least a central position of the same diameter of the propeller to a position beyond the tips of the blades of the propeller.

The ratio of the cross-section of the air flow duct to the area of the disc generated by the propeller is between 1:5 and 1:50.

The air is thus drawn through the device of the invention and on reaching the vicinity of the propeller in a depression area, it causes it to cavitate and reduce the water flow through the propeller, thereby reducing the resistant torque and causing the engine r.p.m.'s to immediately rise with an increase of the engine drive torque. By gradually reducing the air quantity drawn through the device, it is therefore possible to keep the engine r.p.m.'s at maximum torque level and to regulate the thrusting rate of the propeller; maximum torque for the entire time required to attain planing can be used and thus optimum operating conditions for the engine-propeller unit are obtained.

In this manner, the operating conditions are considerably more favorable than those permitted by conventional solutions in which the engine r.p.m.'s are gradually raised to attain maximum torque only when hydrodynamic planing conditions are reached.

If the device of the invention is installed in a watercraft with two or more propellers, it will comprise an air flow duct in correspondence with each propeller present; the ducts can be rigid with each other to form an integral body.

It is apparent to an expert in the art that a large number of embodiments of the device according to the invention are possible and these can be easily adapted to any engine type and power and to any form of planing or semiplaning keel.

Further scope of applicability of the present invention will become apparent from the detailed description given hereinafter.

However it should be understood that the detailed description and specific examples, while indicating preferred embodiments of the invention, are given by way of illustration only, since various changes and modifications within the spirit and scope of the invention will become apprent to those skilled in the art from this detailed description.

BRIEF DESCRIPTION OF THE DRAWINGS

Some preferred embodiments of the device according to the invention are described hereinafter with particular reference to the accompanying drawings of FIG. 1 and 2 which are given by way of illustration only, and thus are not limitive of the present invention, and in which.

DESCRIPTION OF THE PREFERRED EMBODIMENTS

Figure 1:
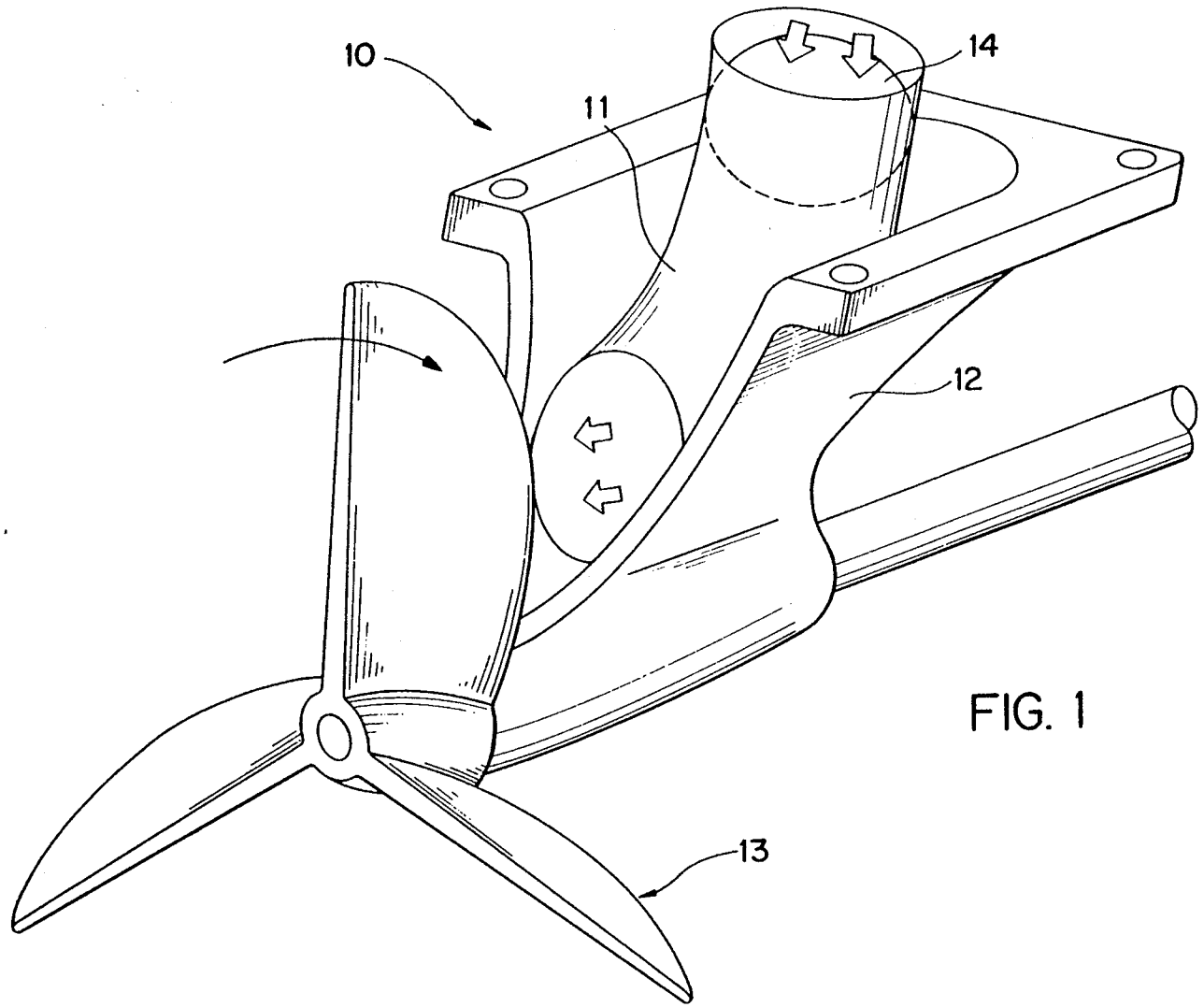
FIG. 1 is a diagrammatic view of a device mounted in a fixed manner on the support of the corresponding propeller.
Figure 3:
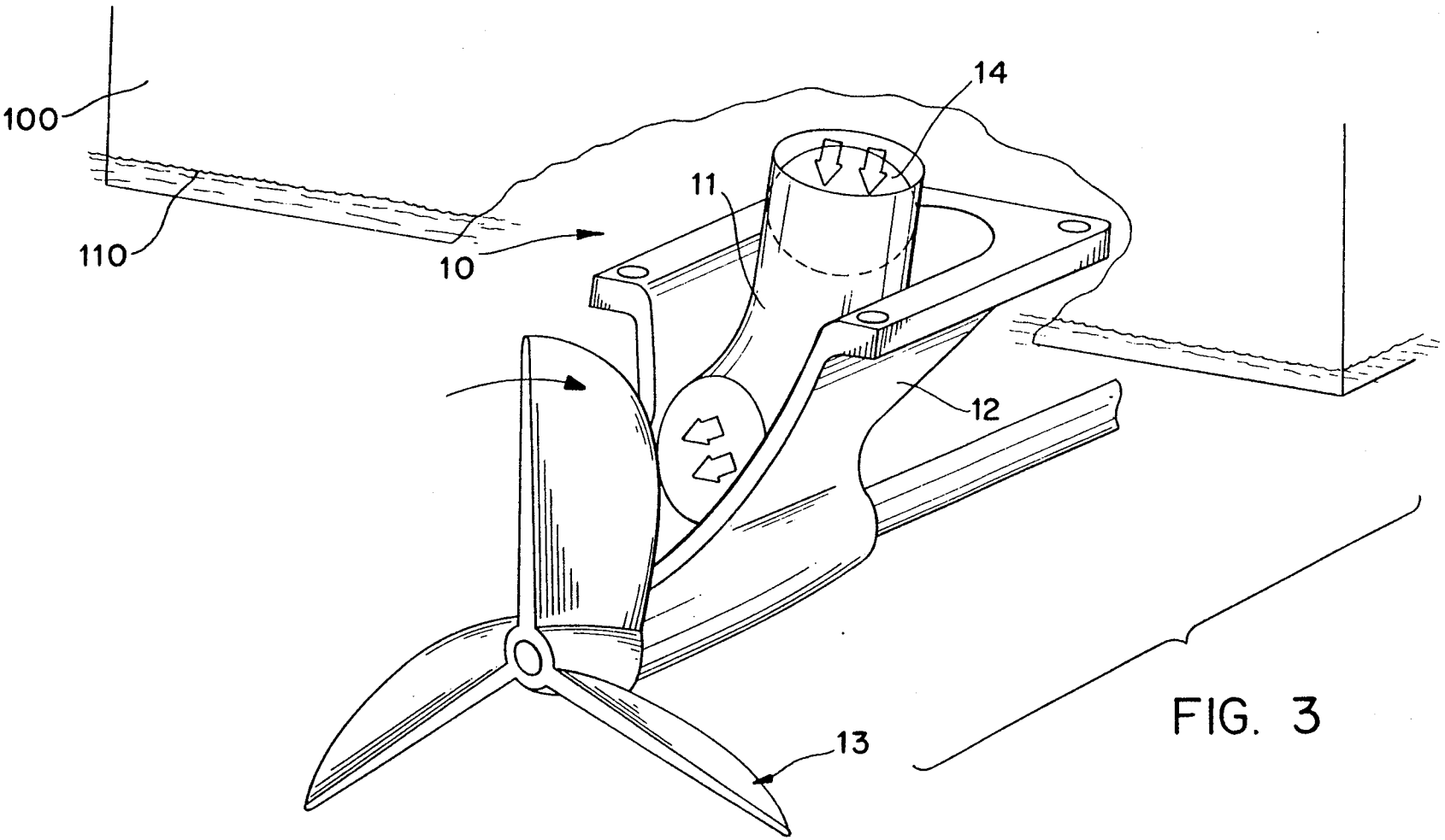
FIG. 3 is a diagrammatic view of a device mounted to the hull of a watercraft.

In FIG. 1, the device 10 consists of an air flow duct 11 fixed to the support 12 for the propeller 13. The support 12 is connected to the hull of the watercraft 100 is shown in FIG. 3. The propeller support 12 is suitably shaped to be able to also support the tube and to generate in the front part of the propeller a depression area favorable for the cavitation of the same propeller, until the planing conditions are reached. The top of the tube 11 communicates with atmosphere above the water line 110 and therefore enables the air to flow through, drawn in by the movement of the propeller 13, in the depression area generated by said propeller 13 and support 12. The air flow to the propeller is controlled by the valve 14 disposed at the top of the tube 11.

The device is particularly suitable for hulls with a surface propeller. Once these hulls are planed, the support 12 stays out of the water and does not offer resistance to the advancement of the same hull. This support 12 is built large in order to generate the depression for cavitation.

Figure 2:
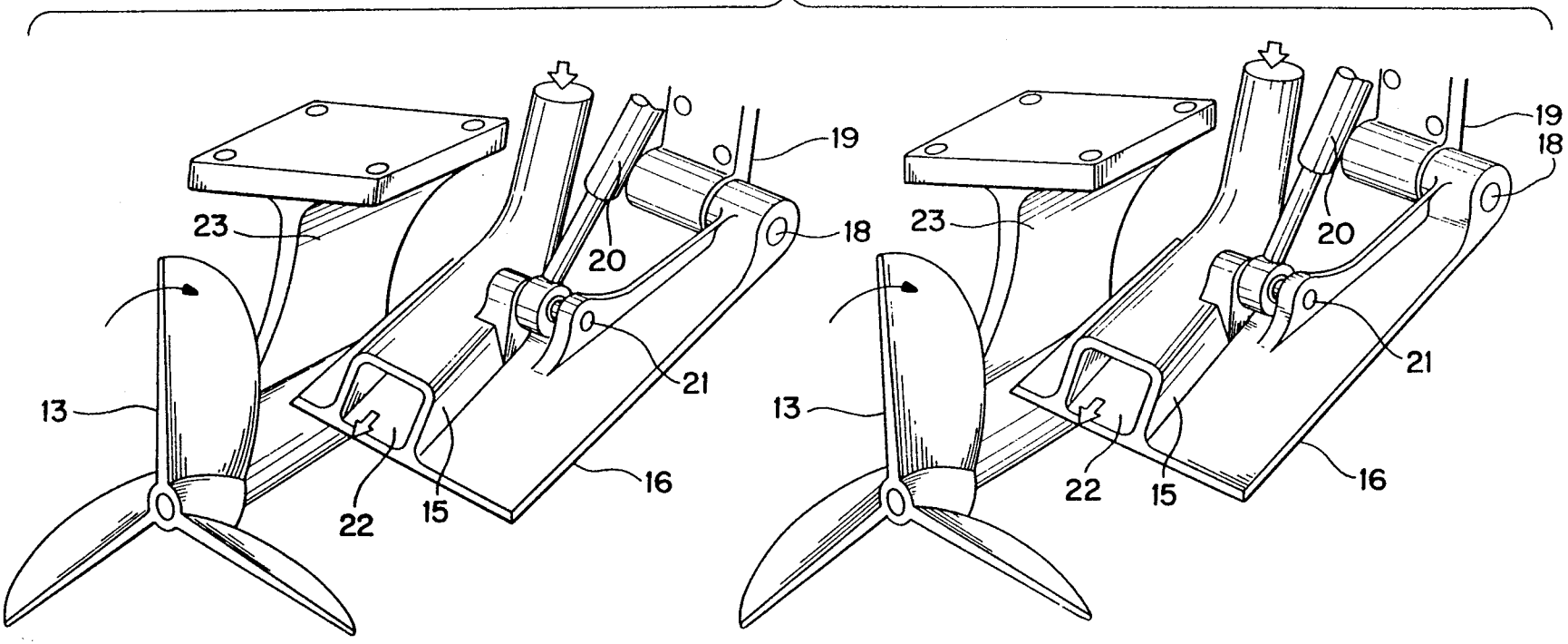
FIG. 2 is a diagrammatic view of a device mounted on a flap and also showing the corresponding propeller.

The device of FIG. 2 consists of two ducts 15 rigid mounted on flaps 16 connected by pins 18 to supports 19 which serve to fix the device to the hull of the watercraft (not shown in the figure).

Hydraulic cylinder-piston units 20 connected to flaps 16 by pins 21 enable the same flaps 16 to be moved about the pins 18 and thus the air flow outlet mouths 22 can be moved relative to the propellers 13 connected to the hull by supports 23. By suitably adjusting the position of the flaps 16 relative to the propellers 13 by means of the cylinder-piston units 20, it is possible to control at will the air flow drawn in above the water line by the movement of the propellers 13, and to generate the desired depression area in front of the same propellers. The propellers will then suck air from the mouths 22, cavitate, and increase their speed. The r.p.m.'s of the engines will increase such that they attain maximum drive torque, and cause the hull to plane.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A device with a cavitational effect for propellers used for propulsion of watercraft with a planing or semiplaning keel, comprising an air flow duct and wall means for generating a depression area, the air flow duct having an outlet adjacent a propeller, the air flow duct withdrawing air from above a hull water line and releasing the air from the outlet directly to a front part of at least the propeller and the wall means generating the depression area in the front part of the propeller, the device further comprises first support means for said propeller and second support means for said air duct, a top of said air flow duct being in communication with the atmosphere above the water line and being provided with a valve for controlling the air flow therethrough, the first support means forming said wall means and being shaped to generate in the front part of said propeller the depression area favorable for cavitation of the propeller, the second support means being constituted by the first support means, the first support means being shaped to support said air duct, the first support means being hollow and enclosing the air duct and the first support means generates in the front part of said propeller the depression area favorable for cavitation of the propeller.

2. The device as claimed in claim 1, wherein a ratio of a cross-section of the air flow duct to an area of a disc generated by the propeller is between 1:5 and 1:50.

3. The device as claimed in claim 1, wherein a plurality of propellers are provided and wherein the air flow duct and means for generating a depression area are provided in correspondence with each of the propellers.

4. A device with a cavitational effect for propellers used for propulsion of watercraft, the device comprising an air flow duct and means for generating a depression area, the air flow duct having an outlet adjacent a propeller, the air flow duct withdrawing air from above a hull water line and releasing the air from the outlet in front of a propeller, the means for generating the depression area comprising a support means which supports at least a portion of the air duct, the support means being readily adjustable relative to the propeller to generate the depression area in front of the propeller and to positionally set the outlet of the air duct along the diameter of the propeller from at least a central portion of the diameter to a position beyond the tips of the blades of the propeller.

5. The device as claimed in claim 4, wherein a plurality of propellers are provided on the watercraft and wherein an air flow duct and means for generating a depression area are provided in correspondence with each of the propellers.

6. The device as claimed in claim 4, further comprising a pin and a hydraulic cylinder-piston, the air flow duct being formed with a flap operatively connected to the hull of the watercraft by the pin, the hydraulic cylinder-piston being connected to the flap and the flap being pivotable about the pin by movement of the hydraulic cylinder-piston, movement of the flap varying positioning of the outlet of the duct relative to the propeller.

7. The device as claimed in claim 4, wherein a ratio of a cross-section of the air flow duct to an area of a disc generated by the propeller is between 1:5 and 1:50.

8. A device with a cavitational effect for propellers for propulsion of watercraft with a planing or semiplaning keel, comprising an air flow duct and wall means for generating a depression area, the air flow duct having an outlet adjacent a propeller, the air flow duct withdrawing air from above a hull water line and releasing the air from the outlet directly to a front part of at least the propeller and the wall means generating the depression area in the front part of the propeller, the device further comprises first support means for said propeller and second support means for said duct, a top of said air flow duct being in communication with the atmosphere above the water line, said second support means forming said wall means and being readily adjustable relative to said propeller to generate in the front part of said propeller the depression area favorable for cavitation of the propeller and to positionally set the outlet of said air duct along the diameter of said propeller from at least a central portion of the diameter of the propeller to a position beyond the tips of the blades of the propeller.

9. The device as claimed in claim 8, wherein an air flow duct is provided in correspondence with each propeller present in the watercraft in which the device is mounted.

10. The device as claimed in claim 8, wherein said support means of said air flow duct is formed by at least a flap operatively connected to the watercraft hull by pin means and hydraulic cylinder-piston means, which enable said flap to be moved relative to said propeller with consequent variation in positioning the outlet of said duct relative to the propeller.

* * * * *